US005328293A

United States Patent [19]

Keefe

[11] Patent Number: 5,328,293

[45] Date of Patent: Jul. 12, 1994

[54] TACTILE TILE

[75] Inventor: Robert F. Keefe, Burlington, Canada

[73] Assignee: Keefe-Dickson Corporation Inc., Burlington, Canada

[21] Appl. No.: 802,318

[22] Filed: Dec. 4, 1991

[51] Int. Cl.[5] ..... E01F 9/00

[52] U.S. Cl. ..... 404/9; 404/15; 404/42

[58] Field of Search ..... 404/9, 19, 32, 35, 36, 404/6, 12, 15, 42, 39; 52/177, 179, 181

[56] References Cited

U.S. PATENT DOCUMENTS 4,080,087 3/1978 Phillips ..... 404/72

4,715,743 12/1987 Schmanski ..... 404/9

*Primary Examiner*—William P. Neuder

*Attorney, Agent, or Firm*—Eugene J.A. Gierczak

[57] ABSTRACT

A tactile tile having a flat plate with a plurality of raised areas, said plate and raised areas comprised of polyurethane.

20 Claims, 1 Drawing Sheet

TACTILE TILE

FIELD OF THE INVENTION

This invention relates to tactile tiles and flooring and in particular relates to tiles having raised areas which are capable of being detected through the sole of shoes, workboots and other footwear soling material, said tiles comprised of thermo plastic polyurethane having increased anti-slip characteristics.

BACKGROUND OF THE INVENTION

Various devices and warning systems have heretofore been constructed in an effort to aid visually handicapped people.

For example, U.S. Pat. No. 4,715,743 teaches a tile comprised of flexible polymer composition which has a top and bottom surface.

Moreover, U.S. Pat. No. 4,620,816 teaches that a walking surface is comprised of a plurality of individual tactual stimuli which are distributed over substantially the entire walking surface.

Moreover, U.S. Pat. No. 4,129,673 relates to a roadway surface marking tape.

Moreover, U.S. Pat. No. 4,080,087 relates to a foot plate which may be fabricated out of a durable material appropriate for the indented use such as conventional weather resistant materials typically used as highway markers.

Such prior art devices have limited durable anti-slip characteristics.

Furthermore, prior art tiles which are utilized to provide direction for a visually handicapped person generally comprise of a flat base with a series of raised areas. The materials used for such prior art tactile tiles have generally limited shear characteristics and in particular such raised areas have a tendency of being sheared off by such devices as snow ploughs, snow shovels and the like.

It is an object of this invention to provide a tactile tile having improved wear resistance characteristics.

It is the broadest aspect of this invention to provide a tactile tile having a flat plate with a plurality of raised areas. Said plate and raised area comprised of polyurethane.

It is another aspect of this invention to provide a tile for positioning on a sidewalk or a road surface to provide direction to visually handicapped persons comprising: a flat plate having an upper surface and a lower surface; a plurality of raised areas diagonally disposed on said upper surface; an epoxy adhesive presented on said lower surface for adhering said tile to said road surface; said flat plate and plurality of raised areas comprised of thermo plastic polyurethane having a −40° centigrade glass transition temperature so as to resist shearing of said raised areas from said flat plate in cold temperatures.

DESCRIPTION OF THE DRAWINGS

These and other objects and features shall now be described in relation to the following drawings.

DESCRIPTION OF THE INVENTION

Like parts have been given like numbers throughout the figures.

Figure 1:
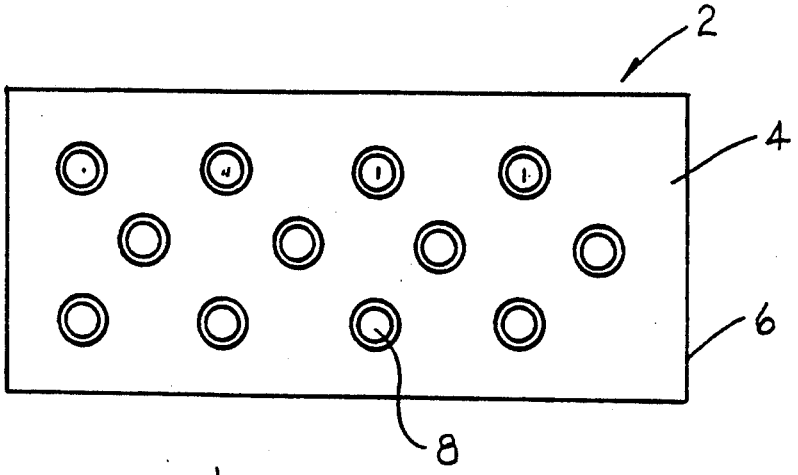
FIG. 1 is a top plan view of said tactile tile having a plurality of circular raised areas.

FIG. 1 generally illustrates the tactile tile 2 which includes a flat plate 4 having a rectangular peripheral edge 6 and a series of spaced raised areas 8 which are diagonally disposed on the upper surface 10 of plate 4. The lower surface 12 of tactile tile 2 has an adhesive 14 which is adapted to adhere the tactile tile 2 to surface 16.

Figure 2:
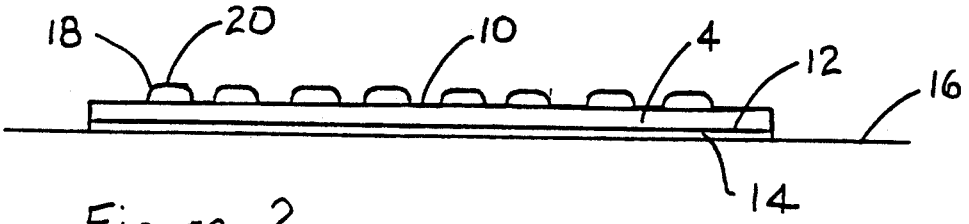
FIG. 2 is a side elevational view of FIG. 1.

The raised areas 8 described in FIGS. 1 and 2 are circular in shape and present rounded edges 18 and a top portion 20. The top portion 20 of raised areas 8 as well as the upper surface 10 presents a roughed surface or pattern so as to present a surface having better grip or anti-slip characteristics.

Furthermore, the space between the raised areas 8 is designed so as to allow the raised areas to be felt through the soles of a shoe (not shown) of a person as well as optimizing the distance so as to minimize the chance of being accidentally tripped by the raised areas. Furthermore, the height and size of the raised areas are designed so as to optimize the tactile sensation of the raised areas through the soles of a shoe as well as to prevent accidental tripping.

Figure 3:
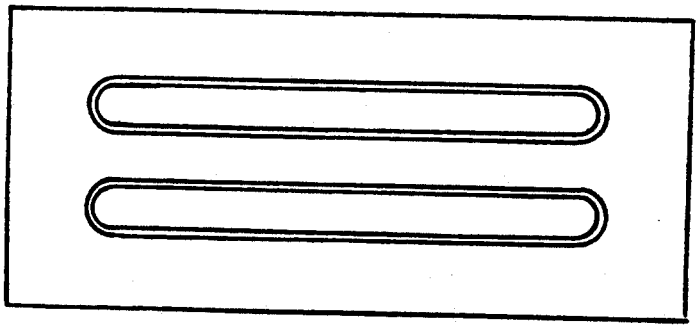
FIG. 3 is a top plan view of said tactile tile having a plurality of bar shaped raised areas.
Figure 4:
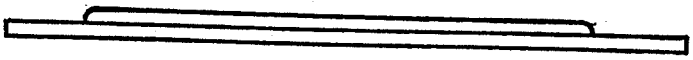
FIG. 4 is a side elevational view of FIG. 3.

FIGS. 3 and 4 are generally similar to FIGS. 1 and 2 except that the raised areas 8 are bar shaped.

The tactile tile described herein can be applied to a sidewalk or a road surface such as the edge of a sidewalk or the like whereby a number of tactile tiles 2 are placed in side by side fashion so as to present a "warning zone". The tactile tiles 2 may be attached to the sidewalk or roadway by utilizing an adhesive 14.

Moreover, the tactile tiles 2 may be utilized along the edge of a platform such as in a subway or the like so as to minimize the chance of a blind person from accidentally walking off the platform since the tactile tiles may be felts through the soles of a visually handicapped person so as to warn them of eminent danger.

The tactile tiles which have been used heretofore have generally poor wear characteristics as well as exhibiting poor shearing characteristics. More particularly, tactile tiles which have heretofore been used in outdoor application deteriorate particularly when they are exposed to winter conditions. A common problem which has been experienced results when snow ploughs or snow shovels are utilized to clear a roadway or sidewalk which presents the tactile tiles. In such circumstances, the raised areas 8 have easily been sheared off by such snow ploughs or snow shovels thereby rendering the tactile tile to be less likely to be experienced through the sole of the user.

Accordingly, it has been found that tactile tiles comprised of polyurethane provide superior weather and chemical resistance and have better slip resistance than most surfaces that are presently available for tactile tiles. In particular, it has been found that excellent wear characteristics are experienced by utilizing a tactile tile comprised of thermo plastic polyurethane having:

| TEAR STRENGTH | GREATER THAN 160 LBS PER LINEAR INCH |
|---|---|
| glass transition temperature | >40° centigrade |
| elongation at brake | >450% |
| modulus of elasticity (M100) | >1,000 lbs per square inch |
| tensile strength | >2,000 psi |
| abrasion resistance | >500 milligrams per 10,000 |

-continued

| | |
|---|---|
| TEAR STRENGTH | GREATER THAN 160 LBS PER LINEAR INCH |
| | cycles |
| coefficient of friction | |
| static | >.6/>.5 |
| dry | >.7/>.5 |

In particular, the abrasion resistance referred to herein refers to a taber abrasion resistance which comprises utilizing a H-18 wheel having a 1,000 gram load applied therein which abrades the sample a rate of 70 r.p.m. In particular, it was found that the taber abrasion of the tactile tile comprised of polyurethane had a total weight loss of less than 270 grams at 10,000 cycles. Moreover, particularly good results have been found when the polyurethane has a taber abrasion resistance of less than 500 milligrams per ten thousand cycles based on ASTM method D with a H-18 wheel. Moreover, particularly good results have also been found where the thermal plastic polyurethane has a tear strength greater than 20 lbs. per linear inch and where the plastic polyurethane has an elongation at break of better than 350%.

The tactile tile 2 described herein is ideal at curb cuts for wheelchair access or bus stops, tops and bottoms of stairs and escalators and sidewalk hazards such as fire hydrants and sign posts. Furthermore, the tactile tiles are generally available in two colours. Yellow for maximum visibility, since yellow is normally the last colour which is visible prior to becoming visually handicapped and black for contrast.

For indoor applications of the tactile tile 2 a simple peal and stick type of butyl adhesive 14 may be utilized while outdoor applications utilize a trawled on two part epoxy adhesive for maximum adhesion.

The tactile tiles 2 described herein are designed for extra warning for secondary caution to be placed closest to a platform edge such as at a subway or the like. The raised dots or raised areas 8 are generally further apart than utilized in prior art tactile tiles to give a more pronounced tactile reference. Such tiles may also be used as a safety tile in manufacturing facilities to help reduce employee injuries. Ideal locations include permitter around moving a robotic machinery, platforms and pedestrian walkways to worn lift truck drivers.

Although the preferred embodiment as well as the operation and use have been specifically described in relation to the drawings, it should be understood that variations in the preferred embodiment could easily be achieved by a man skilled in the art without departing from the spirit of the invention. Accordingly the invention should not be understood to be limited to the exact form revealed by the drawings.

The embodiments of the invention in which an exclusive property or privilege is claimed are defined as follows:

1. In a tactile tile having a flat plate with a plurality of raised areas, said plate and raised areas comprised of polyurethane, wherein said polyurethane has a taber abrasion resistance of less than 500 milligrams per ten thousand cycles based on ASTM method D with a H-18 wheel.

2. In a tactile tile as claimed in claim 1 wherein said plate and raised area is comprised of thermo plastic polyurethane.

3. In a tactile tile having a flat plate with a plurality of raised areas, said plate and raised areas comprised of polyurethane wherein said polyurethane exhibits a −40° centigrade glass transition temperature.

4. In a tactile tile as claimed in claim 2 wherein said thermo plastic polyurethane has a tear strength higher than 20 lbs. per linear inch.

5. In a tactile tile as claimed in claim 4 wherein said thermo plastic polyurethane exhibits a −40° centigrade glass transition temperature.

6. In a tactile tile as claimed in claim 5 wherein said thermo plastic polyurethane has an elongation at break of better than 350%.

7. In a tactile tile as claimed in claim 6 wherein said thermo plastic polyurethane has a modulus of elasticity of greater than 1,000 lbs. per square inch at 100% elongation.

8. In a tactile tile as claimed in claim 7 wherein said thermo plastic polyurethane has a tensile strength of greater than 2,000 lbs. per square inch.

9. In a tactile tile as claimed in claim 8 wherein said flat plate has a rectangular peripheral edge.

10. In a tactile tile as claimed in claim 9 wherein said raised areas are spaced from one another and diagonally disposed on said flat plate.

11. In a tactile tile as claimed in claim 10 wherein said raised areas are circular.

12. In a tactile tile as claimed in claim 11 wherein said raised areas are bar shaped.

13. In a tactile tile as claimed in claim 12 wherein said flat plate presents an upper surface and a lower surface, said raised areas disposed on said upper surface.

14. In a tactile tile as claimed in claim 13 wherein said lower surface has an adhesive for adhering said tactile tile to a sidewalk or a road surface.

15. In a tactile tile as claimed in claim 14 wherein said adhesive comprises an epoxy or urethane adhesive.

16. In a tile for positioning on a road surface to provide direction for visually handicapped persons comprising:

(a) a flat plate having an upper surface and a lower surface;

(b) a plurality of raised areas diagonally disposed on said upper surface;

(c) an epoxy adhesive presented on said lower surface for adhering said tile to said road surface;

(d) said flat plate and plurality of raised areas comprised of thermo plastic polyurethane having a −40° centigrade glass transition temperature so as to resist shearing of said raised areas from said flat plate in cold temperatures.

17. In a tile as claimed in claim 16 wherein said plurality of raised areas are capable of being detected through the sole of a shoe.

18. In a tile as claimed in claim 17 wherein said raised areas are spaced from one another.

19. In a tile as claimed in claim 18 wherein said raised areas are circular.

20. In a tile as claimed in claim 19 wherein said raised areas are bar shaped.

* * * * *